US011594121B2

(12) United States Patent
Roehm et al.

(10) Patent No.: US 11,594,121 B2
(45) Date of Patent: Feb. 28, 2023

(54) HAND-HELD POWER TOOL

(71) Applicant: Robert Bosch GmbH, Stuttgart (DE)

(72) Inventors: Heiko Roehm, Stuttgart (DE); Christoph Steurer, Urbach (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 17/415,983

(22) PCT Filed: Nov. 26, 2019

(86) PCT No.: PCT/EP2019/082561

§ 371 (c)(1),
(2) Date: Jun. 18, 2021

(87) PCT Pub. No.: WO2020/126346

PCT Pub. Date: Jun. 25, 2020

(65) Prior Publication Data

US 2021/0390842 A1 Dec. 16, 2021

(30) Foreign Application Priority Data

Dec. 21, 2018 (DE) ..... 10 2018 222 694

(51) Int. Cl.
*G08B 21/24* (2006.01)
*B25F 5/00* (2006.01)
*G08B 7/06* (2006.01)

(52) U.S. Cl.
CPC ..... *G08B 21/24* (2013.01); *B25F 5/00* (2013.01); *G08B 7/06* (2013.01)

(58) Field of Classification Search
CPC ..... G08B 21/24; G08B 7/06; G08B 13/1427; G08B 13/2462; B25F 5/00
See application file for complete search history.

(56) References Cited

U.S. PATENT DOCUMENTS

2003/0058107 A1* 3/2003 Ferrier ..... G08B 21/24 340/5.1
2010/0208146 A1* 8/2010 Reams ..... G08C 17/02 340/539.32
2014/0240125 A1 8/2014 Burch et al.
2015/0288125 A1* 10/2015 Sneath ..... F16K 17/0406 72/453.02
2017/0057040 A1* 3/2017 Rzasa ..... B23Q 17/2409
2018/0078422 A1* 3/2018 Dierenbach ..... A61F 11/045
2018/0241488 A1 8/2018 Daoura et al.
2018/0369691 A1* 12/2018 Rihn ..... G06F 3/016
2019/0221086 A1* 7/2019 Cruz-Hernandez .... G05B 19/00
2019/0363502 A1* 11/2019 Glockseisen ..... B25B 27/10

FOREIGN PATENT DOCUMENTS

DE 10 2015 217 826 A1 3/2017
EP 3 315 990 A1 5/2018
WO 2016/165869 A2 10/2016

OTHER PUBLICATIONS

International Search Report corresponding to PCT Application No. PCT/EP2019/082561, dated Mar. 18, 2020 (German and English language document)(5 pages).

* cited by examiner

*Primary Examiner* — Brian Wilson
(74) *Attorney, Agent, or Firm* — Maginot, Moore & Beck LLP

(57) ABSTRACT

In a method for locating a hand-held power tool using a communications unit, the communications unit receives an activation signal. A locating signal is triggered when the activation signal is received.

16 Claims, 2 Drawing Sheets

HAND-HELD POWER TOOL

This application is a 35 U.S.C. § 371 National Stage Application of PCT/EP2019/082561, filed on Nov. 26, 2019, which claims the benefit of priority to Serial No. DE 10 2018 222 694.6, filed on Dec. 21, 2018 in Germany, the disclosures of which are incorporated herein by reference in their entirety.

The present disclosure relates to a method for locating a hand-held power tool, having the features described herein.

BACKGROUND

A monitoring system for hand-held power tools having wireless modules is already known from WO 2016/165869 A2.

SUMMARY

The present disclosure proceeds from a method for locating an electric apparatus, in particular a hand-held power tool, having a communications unit, wherein an activating signal is received by the communications unit. It is proposed that a locating signal is triggered upon receiving the activating signal.

The disclosure provides a method for locating an electric apparatus, in particular a hand-held power tool, by means of which a user can reliably locate the electric apparatus, in particular the hand-held power tool, in a working environment, by triggering the locating signal upon receiving the activation signal.

In the context of the present disclosure, an "electric apparatus" is to be understood to be a machine tool, a hand-held power tool, a gardening implement, a gardening tool, or a vacuum apparatus.

In the context of the present disclosure, a "hand-held power tool" is in particular to be understood as a manually guided machine tool, preferably a rechargeable battery operated hand-held power tool. In an exemplary manner, the hand-held power tool can be configured as a screwdriver, a screwdriver/drill, an impact screwdriver, a rotary impact screwdriver, a studwork screwdriver, a jigsaw, or as an angle drill machine.

The electric apparatus, in particular the hand-held power tool, has the communications unit. The communications unit of the electric apparatus, in particular of the hand-held power tool, here can be disposed on the electric apparatus, in particular the hand-held power tool. It is moreover conceivable that the communications unit is, in particular releasably, connected to the electric apparatus, in particular the hand-held power tool. It is furthermore also possible that the communications unit is configured as a retrofittable communications unit for retrofitting the electric apparatus, in particular the hand-held power tool. In the context of the present disclosure, the communications unit is configured for transmitting and/or receiving communications signals. The communications unit receives the activating signal. The communications signals can be transmitted by way of a line, by way of a wire connection or else by way of conductor paths on a circuit board, and/or the communications signals can be transmitted in a wireless manner. A wireless transmission of the communications signals here can be in the form of Bluetooth, WLAN, infrared, near-field communication (NFC) by means of RFID technology, as well as other wireless transmissions of the communications signals known to the person skilled in the art. Communications protocols used here can be Bluetooth, Smart, GSM, UMTS, LTE, ANT, ZigBee, LoRa, SigFox, NB-IoT, BLE, IrDA, as well as other communications protocols known to the person skilled in the art.

The activating signal is triggered and transmitted by means of an external electric apparatus having a communications unit. The external electric apparatus here can be, for example, a smartphone, a tablet or a computer, whereby a cloud-based interface would also be conceivable. The user can trigger the activating signal by means of a program, in particular an app, for example. The external electric apparatus by means of the communications unit subsequently transmits the activating signal to the communications unit of the electric apparatus, in particular of the hand-held power tool. The communications unit of the electric apparatus, in particular of the hand-held power tool, receives the activating signal. The electric apparatus, in particular the hand-held power tool, here can be switched on or switched off. The communications unit is configured such that the activating signal can be received also in the switched-off state of the electric apparatus, in particular of the hand-held power tool. To this end, the communications unit can have a dedicated power supply unit. It is conceivable that the communications unit when receiving the activating signal sets, in particular switches, the electric apparatus, in particular the hand-held power tool, to a state in which the latter is ready for operation. It is furthermore conceivable that the communications unit when receiving the activating signal switches on the control unit.

According to the disclosure, the communications unit of the electric apparatus, in particular of the hand-held power tool, is configured for triggering the locating signal when the activating signal is received. To this end, the communications unit can transmit the activating signal to a control unit of the electric apparatus, in particular of the hand-held power tool. The control unit can control the electric apparatus, in particular the hand-held power tool, by way of an open loop and/or closed loop. The control unit can in particular control by way of an open loop and/or a closed loop a drive unit of the electric apparatus, in particular of the hand-held power tool. Furthermore, the control unit can convert the activating signal to the locating signal, for example. The locating signal is a signal for locating the electric apparatus, in particular the hand-held power tool, in the working environment of the user. The working environment is an environment surrounding the user, in which environment said user would like to carry out his/her desired activities. The working environment can be a radius of for example 30 m about the user, for example. The working environment can be a construction site or a workshop, for example. As soon as the locating signal is triggered, the user can find, or recover, the electric apparatus, in particular hand-held power tool, in the working environment. In particular, the user can determine a position of the electric apparatus, in particular of the hand-held power tool, in the working environment by means of the locating signal.

In one method step, the locating signal is emitted by means of an output unit. To this end, the control unit can transmit the locating signal to the output unit. The output unit the receives the locating signal and emits the latter. The user can perceive the emitted locating signal and locate the electric apparatus, in particular the hand-held power tool. The electric apparatus, in particular the hand-held power tool, has the output unit. The output unit can be disposed on the electric apparatus, in particular the hand-held power tool. It is also possible that the output unit is, in particular releasably, connected to the electric apparatus, in particular the hand-held power tool. Alternatively, it is also conceivable that the output unit is configured as a retrofittable output unit for retrofitting the electric apparatus, in particular the hand-held power tool. The output unit comprises at least one output element. The output element is configured for outputting, in particular emitting, the locating signal. The output element can be configured, for example, as a loudspeaker, as a display, as at least one LED, or as a vibration element for generating vibrations, or else as an electric motor, a gearbox unit, or as a tool holder. A combination of the output elements mentioned in an exemplary manner is also conceivable. As a result, a compact and cost-effective output unit of the electric apparatus, in particular of the hand-held power tool, can be provided.

In one embodiment, the communications unit can convert the activating signal directly into the locating signal and transmit said activating signal to the output unit so that no control unit is substantially necessary. It is also conceivable here that the communications unit transmits the activating signal to the output unit and the output unit converts the activating signal into the locating signal. This embodiment enables the electric apparatus, in particular the hand-held power tool, to be located substantially without the control unit.

In one method step, the locating step is emitted as an acoustic and/or visual locating signal. To this end, the output unit, in particular the at least one output element, emits the locating signal in the form of the acoustic and/or visual locating signal. As a result, the user can see and/or hear the locating signal so as to locate, find or recover the electric apparatus, in particular the hand-held power tool. For example, the acoustic locating signal can be at least one tone at a specific frequency, at least one tone sequence, or a piece of music. For example, the visual locating signal can be a light of a predefined or adjustable color, or at least a flash of light. For example, the visual signal can be emitted by means of a workplace illumination of the electric apparatus, in particular of the hand-held power tool. The workplace illumination serves for illuminating a workplace, in particular the working environment, of the user. In one embodiment, the acoustic locating signal by way of example can be a vibration, a rhythmic oscillation, or brief shocks.

In an alternative embodiment, the locating signal can be emitted as an haptic locating signal. With the aid of the haptic locating signal, the user can feel the locating signal in order for the electric apparatus, in particular the hand-held power tool, to be located.

In one method step, the locating signal is emitted during a period of 1 s, in particular 10 s, most particularly 15 s. The control unit here triggers the locating signal upon receiving the activating signal, and the output unit emits the locating signal for the period of 1 s, in particular 10 s, most particularly 15 s. The user has a possibility of locating the electric apparatus, in particular the hand-held power tool, during the period. It is conceivable that the locating signal after a predefined interval is re-emitted during the period until the user has located the electric apparatus, in particular the hand-held power tool.

Alternatively, the locating signal can be emitted in a substantially unrestricted manner until a further activating signal or deactivating signal is received and the emission of the locating signal is terminated.

In one method step, the locating signal (190) generates a sound pressure level of 5 dB(A). The output unit, in particular the output element, when emitting the locating signal generates the sound pressure level of at least 5 dB(A) such that the user can locate the electric apparatus, in particular the hand-held power tool. The sound pressure level of at least 5 dB(A) enables that the user can acoustically perceive the locating signal in order for the electric apparatus, in particular the hand-held power tool, to be located.

In one method step, the locating signal is generated by an electric motor which performs rotary oscillations. The electric apparatus, in particular the hand-held power tool, has a drive unit, wherein the drive unit—apart from the electric motor—may also comprise a gearbox unit. The gearbox unit is configured for varying variables of the movement, in particular for adapting, in particular reducing and/or increasing, a rotating speed of the electric motor. In one embodiment, the gearbox unit can be configured as a planetary gearbox, wherein it is also conceivable that the planetary gearbox is shiftable. The electric motor of the electric apparatus, in particular of the hand-held power tool, in at least one operating state is configured for providing a torque for driving a primary drive output element. in one embodiment, the primary drive output element is configured as a primary output shaft. The primary output shaft preferably runs so as to be substantially parallel to an operating direction of the electric apparatus, in particular of the hand-held power tool. In the context of the present disclosure, "substantially parallel" is to be understood to be an alignment in a direction relative to a reference direction, in particular in one plane.

In the context of the present disclosure, "rotary oscillations" are to be understood as at least partial rotations of the electric motor which are performed in an alternating and/or rhythmical manner in a counterclockwise rotating direction and a clockwise rotating direction.

The drive unit, in particular the electric motor, is supplied with power by a power supply unit of the electric apparatus, in particular of the hand-held power tool. The acoustic and/or visual locating signal can be generated by means of the rotary oscillations. In one embodiment of the rotary oscillations, a tone in a frequency range audible to the user can be generated. The rotary oscillations of the drive unit, in particular of the electric motor, generate the tone in the audible frequency region, the tone being able to be perceived by the user as a high-frequency beeping sound. The high-frequency beeping sound can be generated by reversing the polarity of a rotating direction of the electric motor at a high-frequency. The tone can furthermore be generated in the gearbox unit in that teeth of planet gears of at least one planetary stage of the planetary gearbox contact one another, in particular in impact one another, by virtue of the rotary oscillations. The teeth of the planet gears of the planetary stage have a mutual clearance such that said planet gears briefly lose contact during the rotary oscillations and generate the tone in the audible frequency range when coming into contact again. Moreover, the rotary oscillations enable vibrations which can be perceived by the user, because the vibrations can be transmitted by means of an environment of the hand-held power tool. In one preferred embodiment, the drive units represents the output unit for emitting the locating signal.

In one method step, the rotary oscillations have a maximum amplitude of 120°, in particular 30°, most particularly 10°. The maximum amplitude of the rotary oscillations here is to be understood in such a manner that a spacing from a first reversal point of the at least partial rotation of the electric motor from a second reversal point of the at least partial rotation of the electric motor is at most 120°, in particular 30°, most particularly 10°. The first reversal point here can be a changeover of the rotating direction of the electric motor from the counterclockwise to the clockwise rotating direction, or vice versa. The second reversal point can be a changeover of the rotating direction of the electric motor from the clockwise to the counterclockwise rotating direction, or vice versa.

In one method step, a frequency of the rotating oscillations is in a range from 20 Hz to 20 kHz, in particular from 200 Hz to 10 kHz. As a result thereof, an ideally efficient emission of the locating signal by means of the output unit, in particular of the at least one output element, is enabled.

In one method step, the locating signal in the form of a mechanical movement is generated by a tool holder of the electric apparatus, in particular of the hand-held power tool. The electric apparatus, in particular the hand-held power tool, here has the tool holder for connecting to an insertion tool. In one embodiment, the tool holder is assigned to the primary output shaft, in particular connected to the latter, such that the driving action of the primary output shaft can be transmitted to the tool holder. The insertion tool by way of an example can be configured as a screwdriver bit, as a HEX drill, as SDS rapid insertion tools, as a cylindrical shank drill, or else as a socket wrench. In one embodiment, the tool holder can be configured as multi-sided socket, in particular a hexagonal socket. It is also conceivable that the tool holder is shaped as a multi-sided head, or else as a collet chuck.

In one method step, the mechanical movement of the tool holder is performed as a rotating movement at a maximum amplitude of 5°, in particular 2°, most particularly 1°. The rotating movement here can be in the clockwise rotating direction, the counterclockwise rotating direction, or alternate between the two rotating directions. The maximum amplitude of the rotating movement is to be understood such that a spacing from a first point of the rotating movement of the tool holder from a second point of the rotating movement of the tool holder is at most 5°, in particular 2°, most particularly 1°.

In one method step, the mechanical movement of the tool holder is performed as a stroke movement with a maximum stroke length of 3 mm, in particular 2 mm, most particularly 1 mm. A "stroke movement" is to be understood to be an axial movement of the tool holder relative to the primary output shaft. The stroke length here is a length of the one stroke movement, said length being at most 3 mm, in particular 2 mm, most particularly 1 mm.

In one method step, the tool holder performs the mechanical movement during a period of 1 s, in particular 10 s, most particularly 15 s. The tool holder performs the mechanical movement during the period of 1 s, in particular 10 s, most particularly 15 s, such that the user has a possibility for locating the hand-held power tool. It is possible that the tool holder after a predefined interval again performs the mechanical movement during the period until the user has located the electric apparatus, in particular the hand-held power tool.

In one method step, the locating signal is deactivated during an operation of the electric apparatus, in particular of the hand-held power tool. This has the result that the user during the operation of the electric apparatus, in particular of the hand-held power tool, can continue to focus on his/her desired jobs to be carried out. It is avoided that the user is distracted by virtue of the emitted locating signal. The control unit during the operation of the electric apparatus, in particular of the hand-held power tool, detects an operating state of the electric apparatus, in particular of the hand-held power tool, and when receiving the activating signal suppresses the conversion of the latter into the locating signal. It is also conceivable that the communications unit during the operation of the electric apparatus, in particular of the hand-held power tool, when receiving the activating signal suppresses the transmission of the activating signal to the control unit. It is moreover possible that the output unit in the operation of the electric apparatus, in particular of the hand-held power tool, suppresses the emission of the locating signal.

The electric apparatus, in particular the hand-held power tool, moreover comprises a power supply unit and a hand switch. The hand switch can be activated by the user by means of at least one finger so as to control in an open loop and/or closed loop the drive unit of the electric apparatus, in particular of the hand-held power tool. The power supply unit of the electric apparatus, in particular of the hand-held power tool, is provided for supplying energy at least to the drive unit, in particular the electric motor, the communications unit, the control unit and the output unit. The electric apparatus, in particular the hand-held power tool, is preferably a rechargeable battery operated electric apparatus, in particular hand-held power tool, which can be operated by means of at least one rechargeable battery, in particular by means of a hand-held power tool rechargeable battery pack. As a result, the power in this instance is provided by the at least one power supply unit by means of the at least one rechargeable battery. In the context of the present disclosure, a "hand-held power tool rechargeable battery pack" is to be understood to be an assembly of at least one rechargeable battery cell and a rechargeable battery pack housing. The hand-held power tool rechargeable battery pack is advantageously configured for supplying power to commercially available, rechargeable battery pack operated, hand-held power tools. The at least one rechargeable battery cell can be configured, for example, as a Li-Ion rechargeable battery cell having a nominal voltage of 3.6 V. In one embodiment of the disclosure, the at least one rechargeable battery can be disposed, in particular attached, most particularly assembled, so as to be fixed to the housing, and substantially within the hand-held power tool housing. In a further embodiment, it is however also possible that the at least one rechargeable battery is configured as a replaceable rechargeable battery, in particular as a replaceable rechargeable battery pack. Alternatively, the hand-held power tool can be a mains-operated and hand-held power tool which by means of a mains supply cable can be connected to an external mains power socket. The external mains power socket here can provide a voltage of, for example, 100 V, 110 V, 120 V, 127 V, 220 V, 230 V or 240 V at 50 Hz or 60 Hz, or else a three-phase voltage. The potential design embodiments of the external mains power socket, and the available voltages associated therewith, are well known to the person skilled in the art.

In one embodiment, the communications unit can have the dedicated power supply unit for supplying power. For example, the dedicated power supply unit can be a battery, in particular a button cell, a capacitor, or else at least one rechargeable battery. As a result, this enables that the output unit can emit the locating signal independently of the power supply unit of the electric apparatus, in particular of the hand-held power tool.

The disclosure furthermore provides an electric apparatus, in particular a hand-held power tool, for carrying out a method for locating the electric apparatus, in particular the hand-held power tool.

BRIEF DESCRIPTION OF THE DRAWINGS

The disclosure will be explained hereunder by means of a preferred exemplary embodiment. In the drawings hereunder.

DETAILED DESCRIPTION

Figure 1:
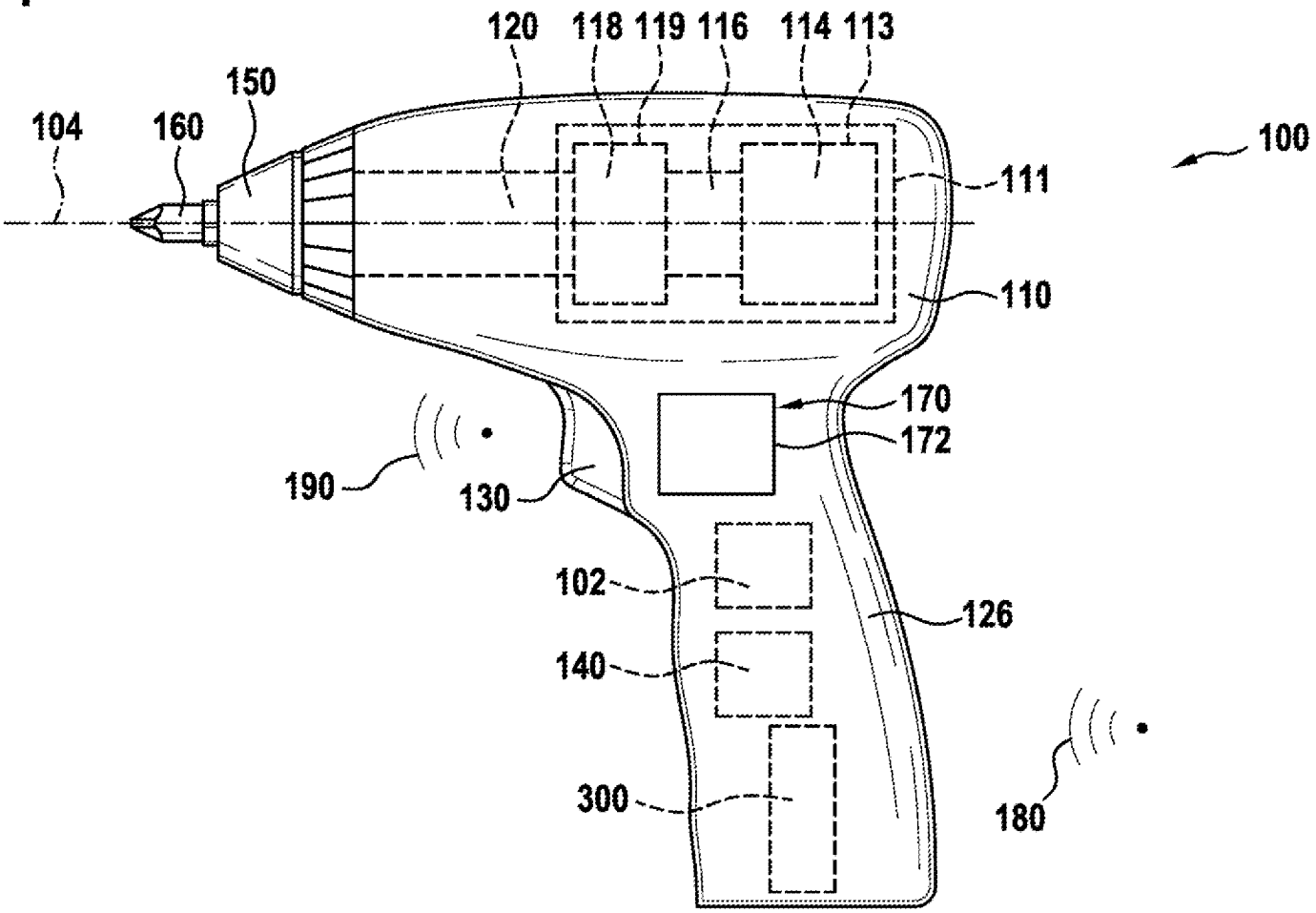
FIG. 1 shows a schematic lateral view of an electric apparatus according to the disclosure.

FIG. 1 shows an electric apparatus according to the disclosure, this here being configured as a hand-held power tool 100. The hand-held power tool 100 in an exemplary manner is configured as an exemplary rechargeable battery screwdriver. The hand-held power tool 100 comprises a primary output shaft 120 and a tool holder 150. The hand-held power tool 100 has a hand-held power tool housing 110 with a handle 126. The hand-held power tool housing 110 here is configured so as to be T-shaped, whereby a pistol-shaped hand-held power tool housing is also conceivable. The hand-held power tool 100 for a mains-free power supply is mechanically and electrically connectable to a power supply for an operation by a rechargeable battery, so that the hand-held power tool 100 is configured as a rechargeable battery operated hand-held power tool 100.

The hand-held power tool housing 110 for illustrative purposes here comprises a drive unit 111. The drive unit 111 furthermore comprises an electric motor 114 having an electric motor housing 113 and a gearbox unit 118. The gearbox unit 118 can be configured as at least one shiftable planetary gearbox. The gearbox unit 118 is connected to the electric motor 114 by way of a motor shaft 116. The gearbox unit 118, by way of the primary output shaft 120, is provided for converting a rotation of the motor shaft 116 into a rotation between the gearbox unit 118 and the tool holder 150. In this embodiment, the primary output shaft 120 serves as a tool axis 104. For illustrative purposes, the gearbox unit 118 is assigned a gearbox housing 119. The gearbox housing 119 in an exemplary manner is disposed in the hand-held power tool housing 110. However, it is also conceivable that the electric motor 114 and the gearbox unit 118 can be disposed directly in the hand-held power tool housing 110 if the hand-held power tool 100 is configured in an "open frame" construction mode. The hand-held power tool 100 furthermore comprises a hand switch 130 which can be activated by the user. The hand switch 130 controls the drive unit 111. The hand-held power tool 100 furthermore has a control unit 102 for controlling in a closed loop and/or open-loop the drive unit 111. The drive unit 111 is switched on when the hand switch 130 is activated by the user. The drive unit 111 is able to be electronically controlled in an open-loop and/or closed loop such that a reversing operation and presetting of a desired rotating speed can be implemented by means of the hand switch 130. The electric motor 114 in this embodiment is configured as an electronically commutated motor.

The tool holder 150 is preferably molded and/or configured on the primary output shaft 120. The tool holder 150 here is configured as a collet chuck which is provided for receiving an insertion tool 160.

The hand-held power tool 100 in this embodiment has a power supply unit 300 for supplying power to the hand-held power tool 100. The power supply here takes place by means of a hand-held power tool rechargeable battery pack not illustrated in more detail. Providing the power by the power supply unit 300 takes place by means of the hand-held power tool rechargeable battery pack, whereby the hand-held power tool rechargeable battery pack is configured so as to be replaceable.

The hand-held power tool 100 in this embodiment comprises a communications unit 140. The communications unit 140 here is disposed within the hand-held power tool housing 110. The communications unit 140 is configured for receiving an activating signal 180. The activating signal 180 is transmitted by an external electric apparatus not illustrated in more detail. A transmission of the activating signal 180 takes place in a wireless manner by means of a wireless connection between the communications unit 140 and the external electric apparatus. The communications unit 140 transmits the activating signal 180 by way of a line to the control unit 102. The control unit 102 receives the activating signal 180 and converts the latter into a locating signal 190.

The hand-held power tool 100 furthermore comprises an output unit 170 for emitting the locating signal 190. To this end, the control unit 102 transmits the locating signal 190 to the output unit 170. The output unit 170 comprises an output element 172 for outputting the locating signal 190. The output unit 170 is preferably the drive unit 111. The locating signal 190 in this embodiment generates a sound pressure level of at least 5 dB(A).

Figure 2:
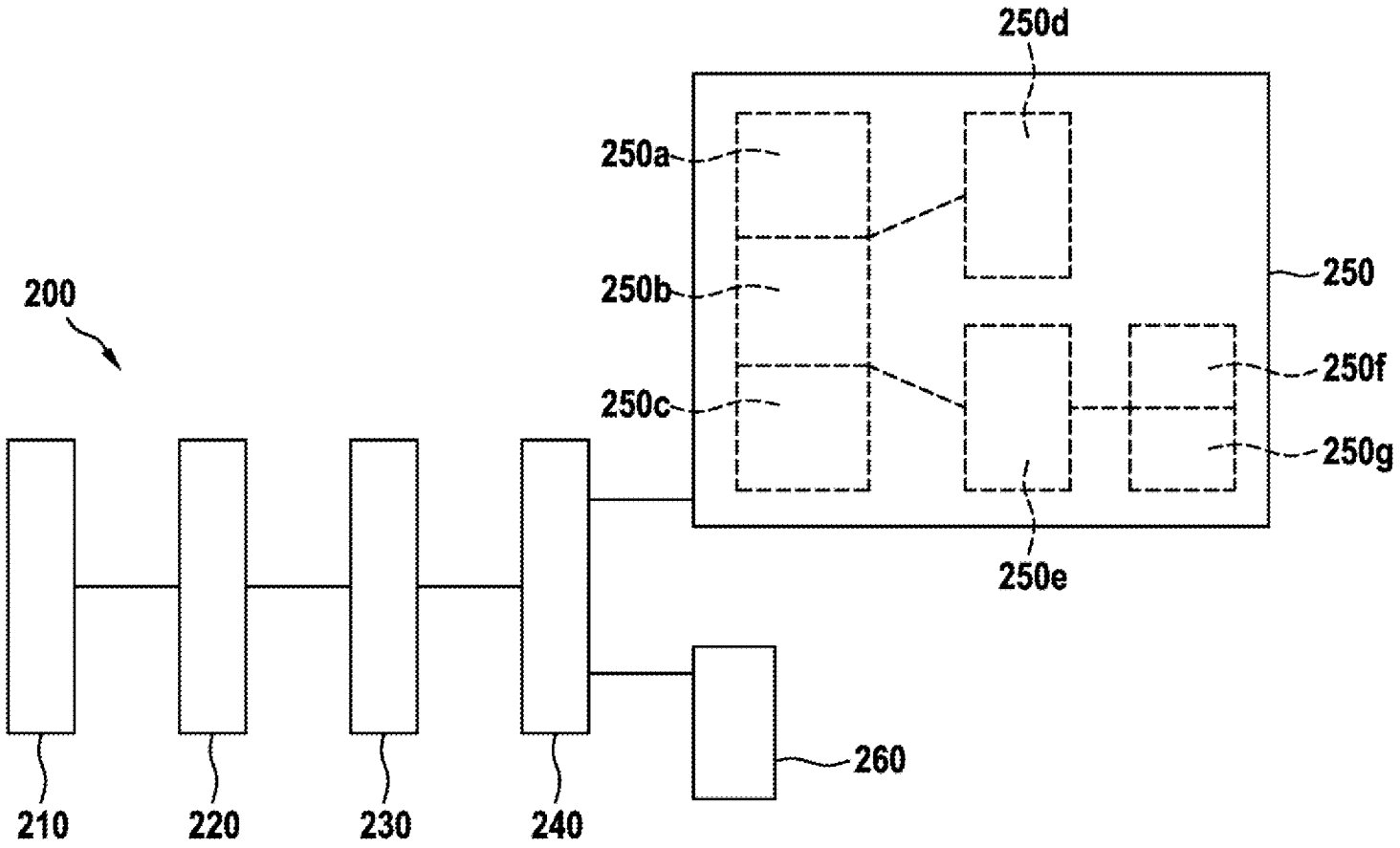
FIG. 2 shows a flow chart of a method according to the disclosure for locating the electric apparatus.

FIG. 2 shows a flow chart 200 of a method according to the disclosure for locating the hand-held power tool 100. In method step 210, the communications unit 140 receives the activating signal 180 from the external electric apparatus. In a method step 220, the communications unit 140 transmits the activating signal 180 to the control unit 102. The control unit 102 in a method step 230 receives the activating signal 180 and converts the latter into the locating signal 190. In method step 240, the control unit 102 transmits the locating signal 190 to the output unit 170. In a method step 250, the output unit 170 by means of the output element 172 emits the locating signal 190 during a period of 1 s. The locating signal 250 here generates at least the sound pressure level of 5 dB(A). In an option 250*a*, the locating signal 190 is emitted as an acoustic locating signal 190*a*, whereas the locating signal 190 in an option 250*b* is emitted as a visual locating signal 190*b*; and in an option 250*c*, the locating signal 190 is emitted as a haptic locating signal 190*c*. A combination of the acoustic locating signal 190*a*, the visual locating signal 190*b* and the haptic locating signal 190*c* is also conceivable. In an option 250*d*, the locating signal 190 is emitted by the electric motor 114 in the form of rotary oscillations. The rotary oscillations here have a maximum amplitude of 120°, whereby a frequency of the rotary oscillations is in a range from 20 Hz to 20 kHz. In an option 250*e*, the locating signal 190 is emitted by the tool holder 150 in the form of a mechanical movement. The mechanical movement of the tool holder 150 is performed during a period of 1 s. In an option 250*f*, the mechanical movement of the tool holder 150 here is a rotating movement with a maximum amplitude of 5°. In an option 250*g*, the mechanical movement of the tool holder 150 is a stroke movement with a maximum stroke length of 3 mm. When the hand-held power tool 100 is in operation and is used by the user, the locating signal 190 is deactivated in a method step 260. The control unit 102 hereby does not transmit the locating signal 190 to the output unit 170.

The invention claimed is:

1. A method for locating a hand-held power tool, the method comprising:

receiving an activating signal with a communications unit of the hand-held power tool; and triggering a locating signal upon receiving the activating signal, the triggering of the locating signal including generating a mechanical movement of a tool holder of the hand-held power tool, the tool holder being configured to receive an insertion tool, the generating of the mechanical movement of the tool holder including performing at least one of (i) a rotating movement and (ii) a stroke movement; and deactivating the locating signal in response to detecting that the hand-held power tool is operated by a user, the locating signal being suppressed upon continuing to receive the activating signal while the user continues to operate the hand-held power tool.

2. The method as claimed in claim 1, wherein the triggering of the locating signal includes emitting the locating signal with an output unit.

3. The method as claimed in claim 1, wherein the triggering of the locating signal includes emitting the locating signal as an acoustic and/or visual locating signal.

4. The method as claimed in claim 1, wherein the triggering of the locating signal includes emitting the locating signal for a period of at least 1 second.

5. The method as claimed in claim 1, wherein the triggering of the locating signal includes emitting the locating signal at least a sound pressure level of at least 5 dB(A).

6. The method as claimed in claim 1, wherein the triggering of the locating signal includes generating the locating signal with an electric motor which performs rotary oscillations.

7. The method as claimed in claim 6, wherein the rotary oscillations have a maximum amplitude of 120°.

8. The method as claimed in claim 7, wherein the maximum amplitude of the rotary oscillations is 10°.

9. The method as claimed in claim 6, wherein a frequency of the rotary oscillations is in a range from 20 Hz to 20 kHz.

10. The method as claimed in claim 9, wherein the frequency of the rotary oscillations is in a range from 200 Hz to 10 kHz.

11. The method as claimed in claim 1, wherein the generating of the mechanical movement of the tool holder includes performing the rotating movement of the tool holder at a maximum amplitude of 5°.

12. The method as claimed in claim 1, wherein the generating of the mechanical movement of the tool holder includes performing the stroke movement of the tool holder with a maximum stroke length of 3 mm.

13. The method as claimed in claim 1, wherein the generating of the mechanical movement of the tool holder includes performing the mechanical movement during a period of at least 1 s.

14. The method as claimed in claim 1, wherein the triggering of the locating signal includes emitting the locating signal for a period of at least 10 seconds.

15. The method as claimed in claim 1, wherein the mechanical movement is generated for a predetermined time period after receiving the activating signal and, after a predetermined time interval, is generated again for the predetermined time period.

16. A hand-held power tool comprising:

a tool holder configured to receive an insertion tool;

a communications unit configured to receive an activating signal; and an output unit configured to trigger a locating signal by generating a mechanical movement of the tool holder, in response to receipt of the activating signal, the generating of the mechanical movement of the tool holder including performing at least one of (i) a rotating movement and (ii) a stroke movement, the output unit being further configured to deactivate the locating signal in response to detecting that the hand-held power tool is operated by a user, the locating signal being suppressed upon continuing to receive the activating signal while the user continues to operate the hand-held power tool.

* * * * *